US010894329B1

(12) United States Patent
Mandeville

(10) Patent No.: US 10,894,329 B1
(45) Date of Patent: Jan. 19, 2021

(54) SWITCHBLADE

(71) Applicant: Mark Mandeville, Fletcher, NC (US)

(72) Inventor: Mark Mandeville, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 16/699,834

(22) Filed: Dec. 2, 2019

(51) Int. Cl.
*B26B 1/04* (2006.01)

(52) U.S. Cl.
CPC ..... *B26B 1/042* (2013.01)

(58) Field of Classification Search
CPC ..... B26B 1/04–048
USPC ..... 30/155, 158–161
See application file for complete search history.

(56) References Cited

U.S. PATENT DOCUMENTS 1,056,404 A 3/1913 Lorenzo
1,231,058 A 6/1917 Pansa
2,854,745 A 10/1958 Braverman
4,089,112 A 5/1978 Richards
4,523,379 A 6/1985 Osterhout
4,744,146 A 5/1988 Schmidt
4,947,552 A 8/1990 Barnes
5,060,379 A 10/1991 Neely
5,511,311 A 4/1996 Collins
5,617,635 A 4/1997 Berns
5,722,168 A * 3/1998 Huang ..... B23D 51/01 30/160
6,085,423 A 7/2000 Marifone
6,154,965 A 12/2000 Sakai
6,434,831 B2 * 8/2002 Chen ..... B26B 1/046 30/155
7,086,158 B1 8/2006 Halpern
7,278,213 B2 * 10/2007 Pardue ..... B26B 1/04 30/159
7,305,729 B2 12/2007 Dehner
7,305,769 B2 12/2007 McHenry
7,337,546 B2 3/2008 Cheng
7,340,836 B2 * 3/2008 Whitemiller ..... B26B 5/001 30/155
7,562,454 B2 * 7/2009 Steigerwalt ..... B26B 1/044 30/159
7,621,051 B2 11/2009 Ping
7,647,702 B2 1/2010 Polei
7,698,821 B2 4/2010 Ralph
7,797,838 B2 9/2010 Chu
7,979,990 B2 7/2011 Hawk et al.
8,375,588 B2 2/2013 Gringer
8,375,590 B2 * 2/2013 Duey ..... B26B 1/048 30/159
8,584,367 B2 * 11/2013 Chu ..... B26B 1/04 30/160

(Continued)

*Primary Examiner* — Jason Daniel Prone
(74) *Attorney, Agent, or Firm* — Steve LeBlanc, LLC

(57) ABSTRACT

A switchblade includes a casing that defines a cavity. A blade having a cutting edge has a retracted position in which the cutting edge is inside the cavity and a deployed position in which the cutting edge is outside the cavity. A spring is operably connected to the blade to bias the blade to the deployed position. An actuator is releasably engaged with the blade, and operation of the actuator allows the blade to move between the retracted position and the deployed position. A safety lever that extends through at least a portion of the casing lever has a lock position that prevents operation of the actuator and an unlock position that permits operation of the actuator.

20 Claims, 14 Drawing Sheets

(56) References Cited

U.S. PATENT DOCUMENTS 8,595,941 B2 12/2013 Lee
8,601,699 B2 * 12/2013 Vellekamp ..... B26B 1/04 30/155
8,646,184 B2 * 2/2014 Westerfield ..... B26B 1/046 30/155
8,671,578 B1 3/2014 Frazer
RE45,801 E * 11/2015 Krudo ..... B26B 1/044
9,205,569 B2 12/2015 Garavaglia
9,505,141 B2 * 11/2016 Duey ..... B26B 1/046
9,573,282 B1 2/2017 Sheahan
9,676,105 B2 6/2017 McChesney
D808,494 S * 1/2018 Marfione ..... D22/118
10,131,059 B2 * 11/2018 Ikoma ..... B26B 1/048
10,189,170 B2 * 1/2019 Marfione ..... B26B 1/044
10,807,253 B1 * 10/2020 Mandeville ..... B26B 1/08
2003/0154605 A1 8/2003 Chao
2004/0158991 A1 * 8/2004 Freeman ..... B26B 1/048 30/161
2006/0230620 A1 * 10/2006 Steigerwalt ..... B26B 1/044 30/159
2007/0256304 A1 * 11/2007 Pardue ..... B26B 1/046 30/160
2008/0172884 A1 * 7/2008 Cheng ..... B26B 1/02 30/155
2009/0193664 A1 * 8/2009 Galyean ..... B26B 1/046 30/161
2009/0260234 A1 * 10/2009 Lai ..... B26B 1/046 30/161
2009/0313765 A1 * 12/2009 Krudo ..... B26B 1/048 30/159
2011/0283543 A1 11/2011 Wu
2012/0216412 A1 8/2012 Chung
2013/0160300 A1 6/2013 Liu
2014/0115899 A1 * 5/2014 Frazer ..... B26B 1/048 30/160
2015/0352730 A1 * 12/2015 Duey ..... B26B 1/048 30/159
2016/0075037 A1 * 3/2016 Ikoma ..... B26B 1/046 30/161
2017/0015009 A1 1/2017 Tseng
2017/0246747 A1 8/2017 Schmidt

* cited by examiner

SWITCHBLADE

FIELD OF THE INVENTION

The present invention generally involves a switchblade. In particular embodiments, the switchblade may be single or double action in either a folding or out-the-front configuration.

BACKGROUND OF THE INVENTION

Pocket knives provide a convenient tool for cutting that may be easily carried by a user for deployment when desired. For some pocket knife designs, two hands are needed to deploy and retract a blade, while other designs include a spring that assists a user to deploy and/or retract the blade using a single hand. Each design balances the convenience and speed of operation with increased risk associated with inadvertent operation.

A switchblade is a particular style of pocket knife that has a folding or sliding blade that automatically deploys when an actuator is operated. For a single action switchblade, a spring may be engaged in tension with the blade, and operation of the actuator releases the blade to allow the spring to automatically deploy the blade. Once deployed, the actuator is released to hold the blade in the deployed position. To retract a single action switchblade, the actuator is again operated to release the blade, and the blade must be manually retracted against the spring tension. For a double action switchblade, operation of the actuator creates tension between the spring and the blade to automatically deploy and retract the blade.

Although a switchblade provides convenient one-handed operation, the convenience of operation also increases the risk that the actuator may be inadvertently operated. For example, the actuator may be inadvertently bumped while the switchblade is in a pocket or attached to a belt, causing the blade to automatically deploy in a manner that may cause personal injury or damage. Alternately, the actuator may be inadvertently bumped while the blade is deployed, releasing the blade from a fixed position. As a result, the need exists for an improved switchblade that reduces inadvertent operation of the actuator.

BRIEF DESCRIPTION OF THE INVENTION

Aspects and advantages of the invention are set forth below in the following description, or may be obvious from the description, or may be learned through practice of the invention.

One embodiment of the present invention is a switchblade that includes a casing that defines a cavity. A blade having a cutting edge has a retracted position in which the cutting edge is inside the cavity and a deployed position in which the cutting edge is outside the cavity. A spring is operably connected to the blade to bias the blade to the deployed position. An actuator extends through at least a portion of the casing and has a hold position that prevents movement of the blade with respect to the casing and a release position that permits movement of the blade with respect to the casing. A safety lever pivotally connected to the casing lever has a lock position that prevents operation of the actuator and an unlock position that permits operation of the actuator.

An alternate embodiment of the present invention is a switchblade that includes a casing that defines a cavity. A blade having a cutting edge has a retracted position in which the cutting edge is inside the cavity and a deployed position in which the cutting edge is outside the cavity. A spring is operably connected to the blade to bias the blade to the deployed position. An actuator is releasably engaged with the blade, and operation of the actuator allows the blade to move between the retracted position and the deployed position. A safety lever that extends through at least a portion of the casing lever has a lock position that prevents operation of the actuator and an unlock position that permits operation of the actuator.

In yet another embodiment of the present invention, a switchblade includes a casing that defines a cavity and a blade having a cutting edge. The blade has a retracted position in which the cutting edge is inside the cavity and a deployed position in which the cutting edge is outside the cavity. A spring is operably connected to the blade to bias the blade to the deployed position. An actuator extends through at least a portion of the casing, and operation of the actuator allows the blade to move between the retracted position and the deployed position. A safety lever at least partially inside the casing has a lock position that prevents operation of the actuator and an unlock position that permits operation of the actuator.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
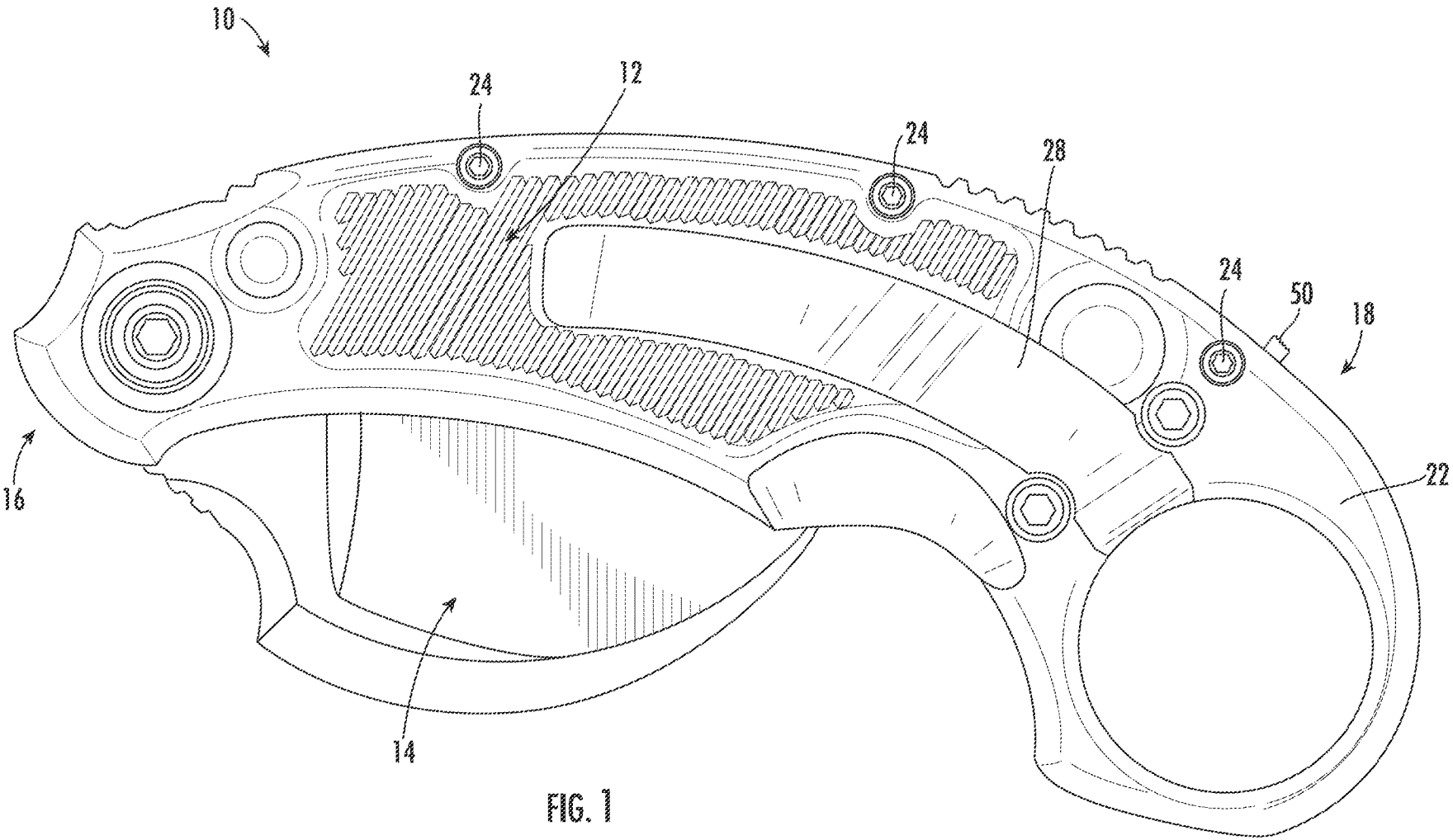
FIG. 1 is a bottom plan view of a switchblade in a retracted position according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a switchblade with an actuator and a safety lever that provide enhanced protection against inadvertent operation of the actuator. Although various embodiments are illustrated as a folding, single action switchblade, one of ordinary skill in the art will readily appreciate that embodiments of the present invention may include an out-the-front switchblade and/or a double action switchblade, and the present invention is not limited to a particular configuration or action unless specifically recited in the claims.

Figure 2:
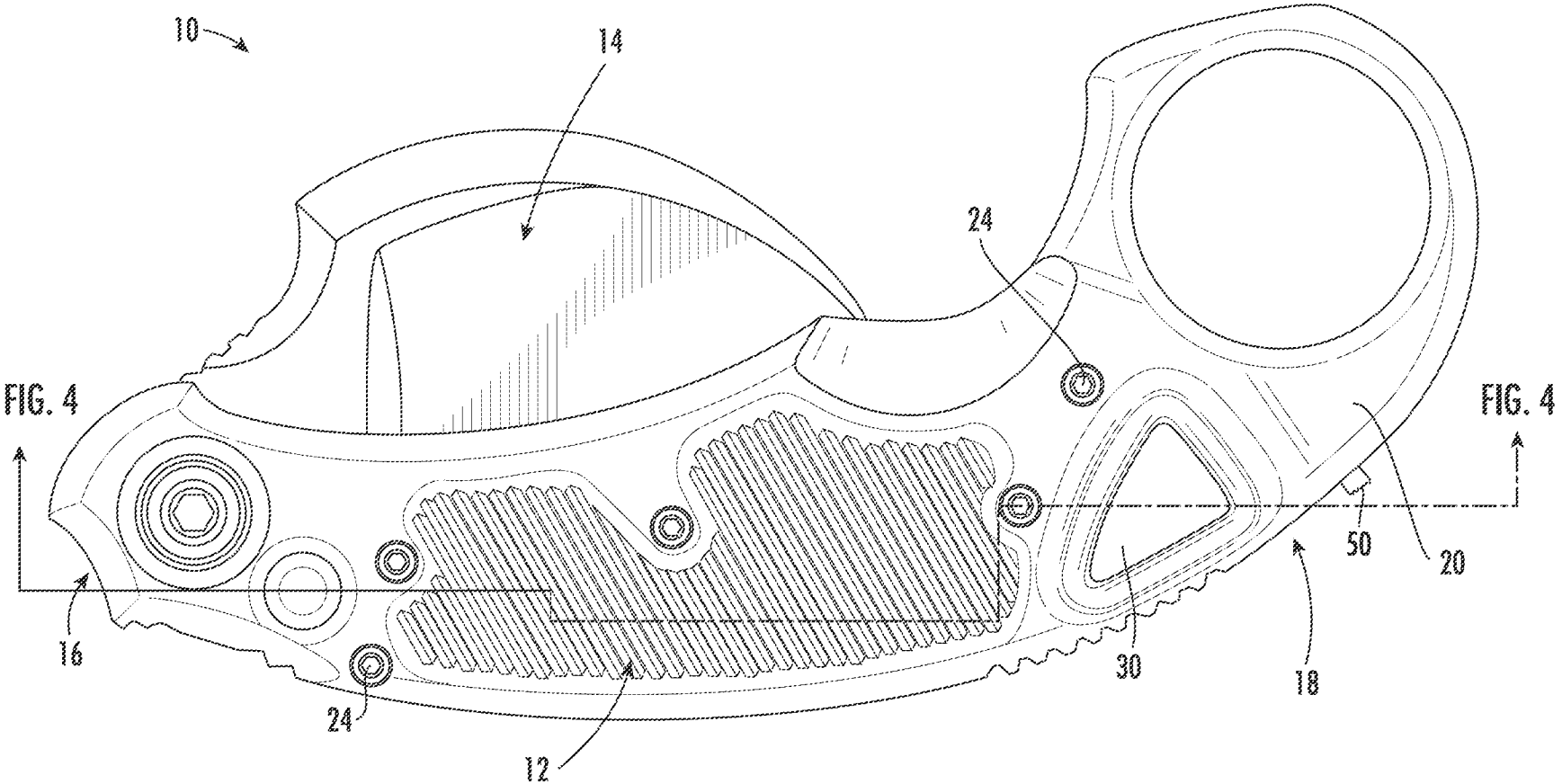
FIG. 2 is a top plan view of the switchblade shown in FIG. 1.

FIG. 1 provides a bottom plan view of a switchblade 10 in a retracted position according to one embodiment of the present invention, and FIG. 2 provides a top plan view of the switchblade 10 shown in FIG. 1. As shown in FIGS. 1 and 2, the switchblade 10 generally includes a casing 12 that houses and supports a blade 14. The casing 12 has a first end 16 opposed to a second end 18. As used herein, the first and second ends 16, 18 refer to the general areas of the casing 12 and not the extreme ends of the casing 12. The casing 12 may include a top or first scale 20 opposed to a bottom or second scale 22 and connected together by screws 24 to define a cavity 26 (shown in FIG. 4) between the first and second scales 20, 22. As shown in FIG. 1, the switchblade 10 may further include a pocket clip 28 connected at the second end 18 of the casing 12. The switchblade 10 further includes an actuator 30 that controls operation the blade 14 between retracted and deployed positions. In the particular embodiment shown in FIG. 2, the actuator 30 is generally located at the second end 18 of the casing 12 and may extend through at least a portion of the first scale 20 of the casing 12.

Figure 3:
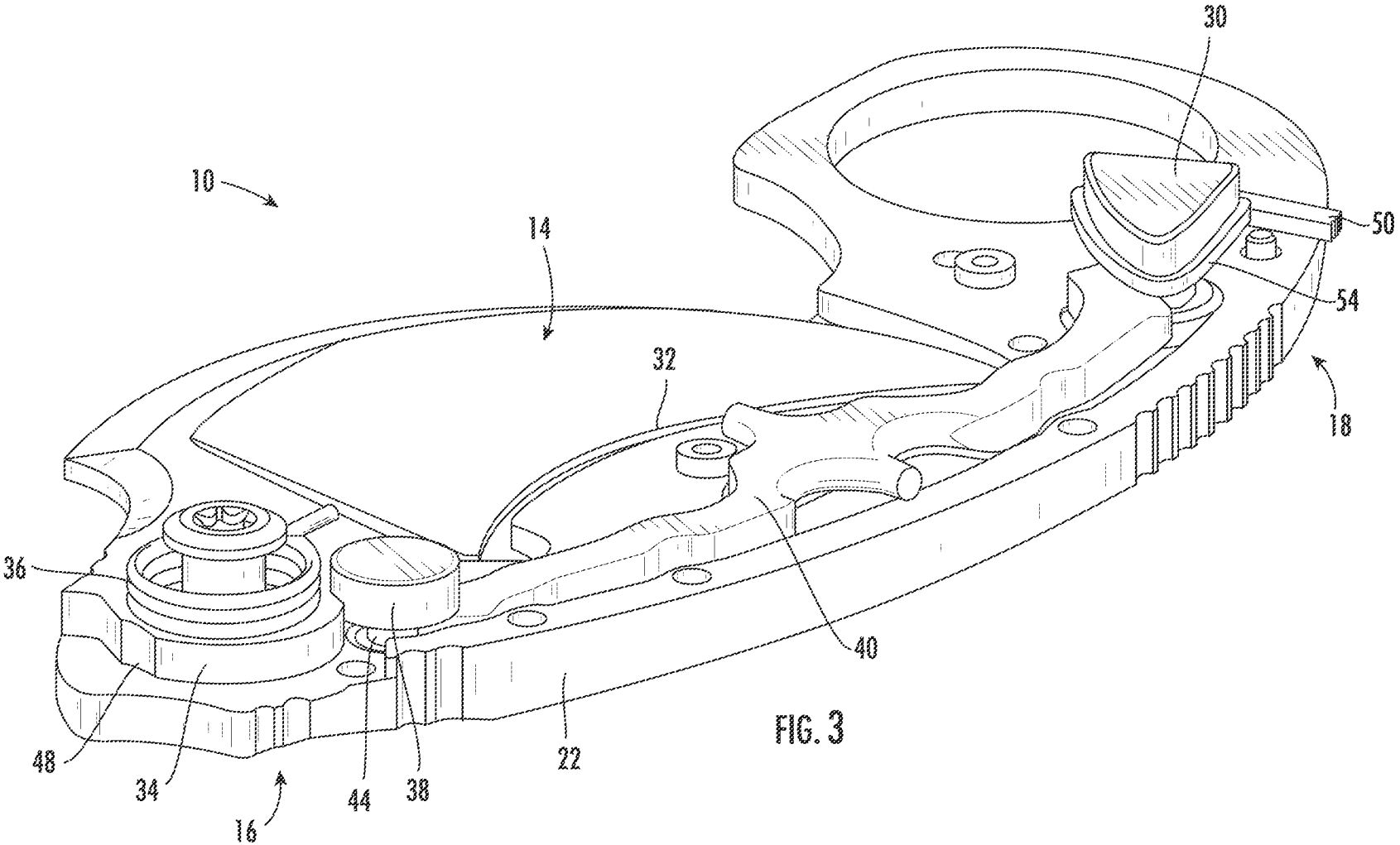
FIG. 3 is a top perspective view of the switchblade shown in FIG. 2 with the top scale removed.
Figure 4:
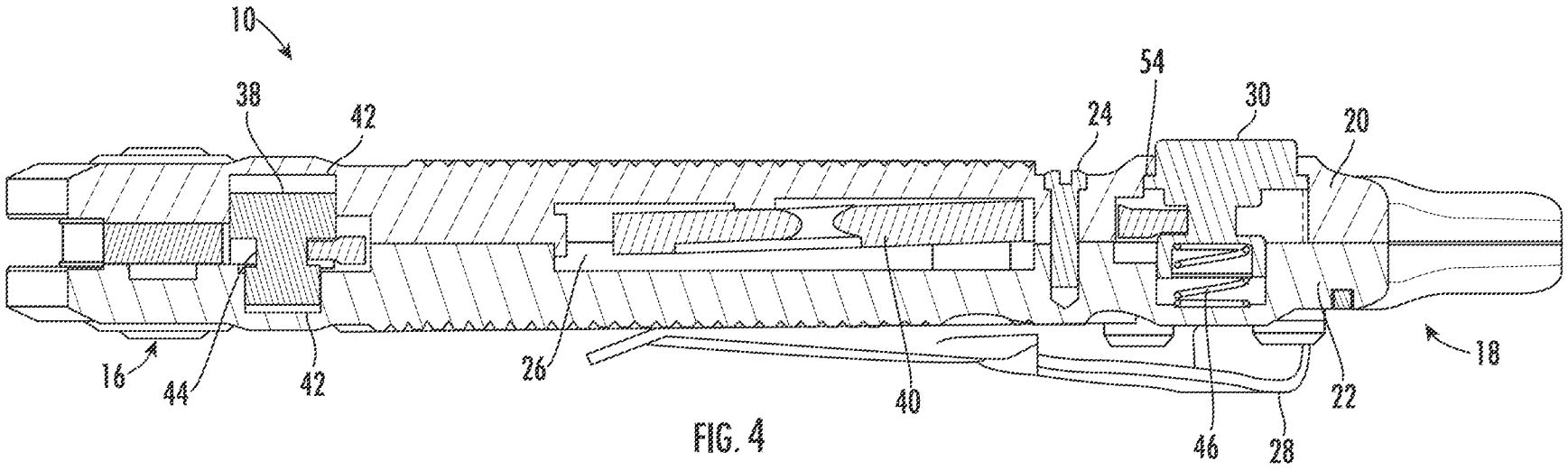
FIG. 4 is a cross-section view of the switchblade shown in FIG. 2 taken along line 4-4.

FIG. 3 provides a top perspective view of the switchblade 10 shown in FIG. 2 with the first scale 20 removed, and FIG. 4 provides a cross-section view of the switchblade 10 shown in FIG. 2 taken along line 44. As shown in FIG. 3, the blade 14 generally includes a cutting edge 32 on one or both sides of the blade 14. In particular embodiments, the cutting edge 32 may be curved, straight, and/or serrated. The blade 14 has a retracted position (shown in FIGS. 1-5) in which the cutting edge 32 is inside the cavity 26 and a deployed position (shown in FIG. 6) in which the cutting edge 32 extends outside the cavity 26 from the first end 16 of the casing 12. In this particular embodiment, the blade 14 includes a tang 34 pivotally connected at the first end 16 of the casing 12. A spring 36 is operably connected to the tang 34 of the blade 14 to bias the blade 14 to the deployed position.

As shown in FIGS. 3 and 4, the switchblade 10 may further include a lock 38 and a lever 40 inside the cavity 26. The actuator 30 and the lock 38 have a hold position and a release position. In the hold position, the actuator 30 releasably engages with the blade 14 through the lock 38 to prevent movement of the blade 14 with respect to the casing 12. In the release position, the actuator 30 and the lock 38 disengage from the blade 14 to permit movement of the blade 14 with respect to the casing 12. For example, the lock 38 may be located in a recess 42 defined by the first and second scales 20, 22 at the first end 16 of the casing 12 and may include a relief 44. The lever 40 pivots with respect to the casing 12 and extends from the lock 38 at the first end 16 of the casing 12 to the actuator 30 at the second end 18 of the casing 12. In this manner, the actuator 30 is connected to the lock 38 by the lever 40, and an actuator spring 46 engaged with the actuator 30 may bias the actuator 30 away from the second scale 22 to the hold position. With the actuator 30 biased away from the second scale 22 to the hold position, the lever 40 pivots with respect to the casing 12 to force the lock 38 toward the second scale 22 to the hold position. In the hold position, the lock 38 engages with detents 48 in the tang 34 of the blade 14 when the blade 14 is in the retracted or deployed positions to prevent movement of the blade 14 with respect to the casing 12. When the actuator 30 is depressed toward the second scale 22 to the release position to overcome the bias of the actuator spring 46, the lever 40 pivots with respect to the casing 12 to force the lock 38 away from the second scale 22 to the release position. In the release position, the lock 38 disengages from the detents 48 in the tang 34 of the blade 14, and the tang 34 of the blade 14 may pass through the relief 44 in the lock 38 to permit movement of the blade 14 with respect to the casing 12.

Figure 5:
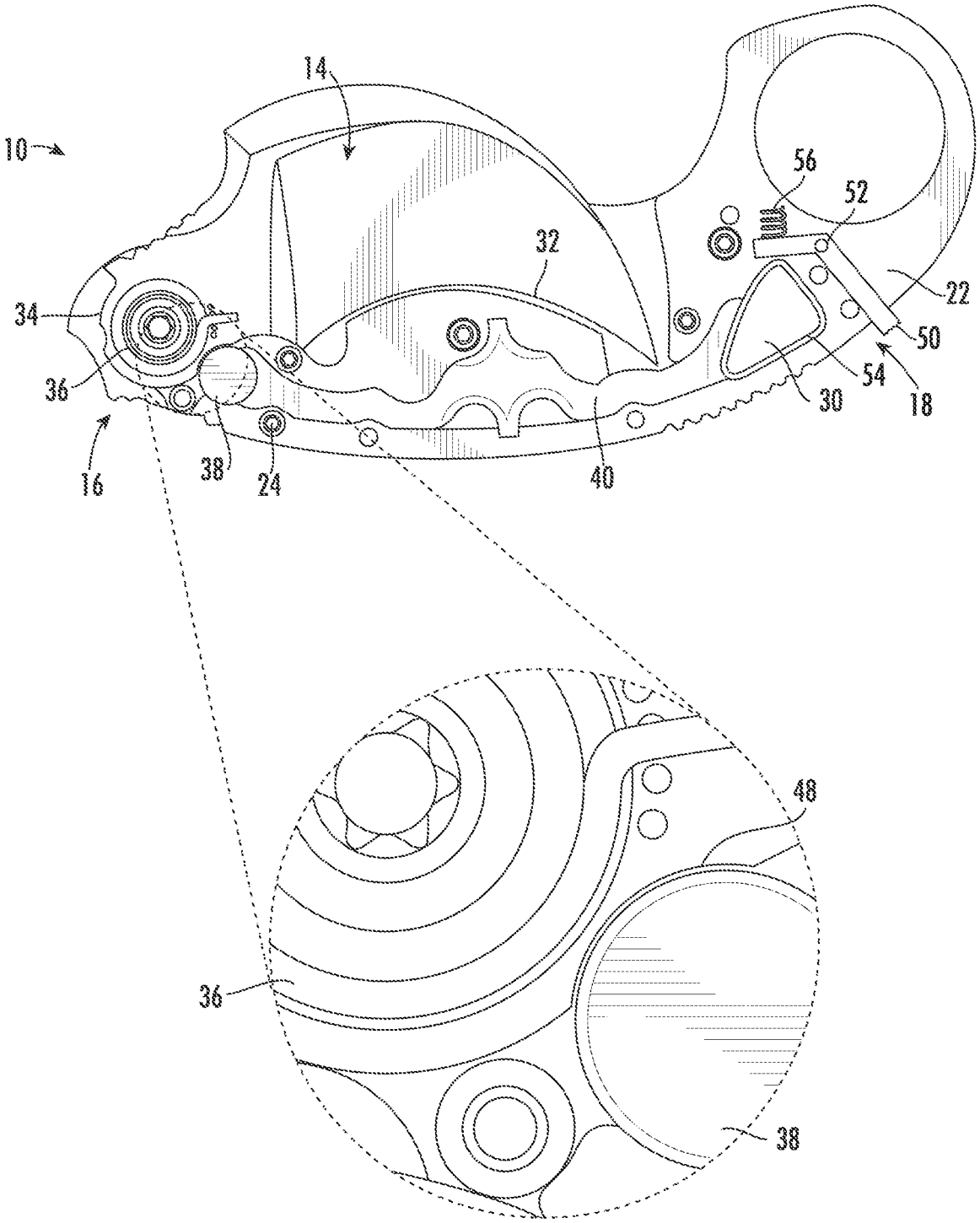
FIG. 5 is a top plan view of the switchblade shown in FIG. 2 with the top scale removed and an enlarged view of the lock in the switchblade.
Figure 6:
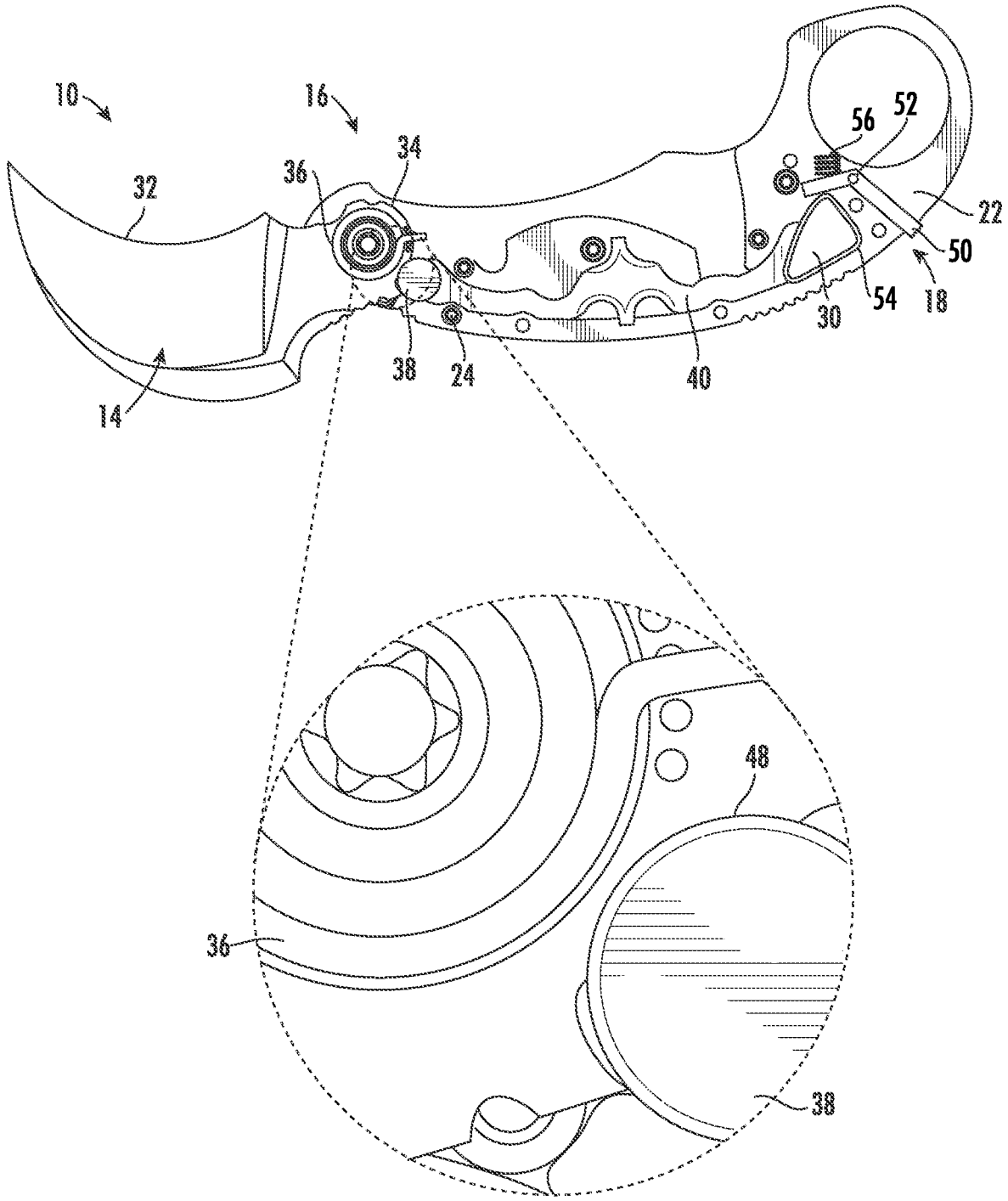
FIG. 6 is a top plan view of the switchblade shown in FIG. 2 in an extended position with the top scale removed and an enlarged view of the lock in the switchblade.

FIG. 5 provides a top plan view of the switchblade 10 shown in FIG. 2 with the first scale 20 removed and an enlarged view of the lock 38, and FIG. 6 provides a top plan view of the switchblade 10 shown in FIG. 2 in an extended position with the first scale 20 removed and an enlarged view of the lock 38. In the retracted position shown in FIG. 5, the cutting edge 32 is inside the cavity 26. The actuator 30 is biased by the actuator spring 46 away from the second scale 22 to the hold position, and the lever 40 forces the lock 38 toward the second scale 22 to the hold position. In the hold position, the lock 38 engages with the detent 48 in the tang 34 of the blade 14 to prevent the spring 36 from rotating the blade 14 with respect to the casing 12.

To deploy the blade 14, the actuator 30 is depressed toward the second scale 22 to the release position to overcome the bias of the actuator spring 46, and the lever 40 pivots with respect to the casing 12 to force the lock 38 away from the second scale 22 to the release position. In the release position, the lock 38 disengages from the detent 48 in the tang 34 of the blade 14, and the spring 36 causes the tang 34 of the blade 14 to pass through the relief 44 in the lock 38 to rotate the blade 14 with respect to the casing 12 to the deployed position as shown in FIG. 6. With the blade 14 in the deployed position, the actuator 30 is released, and the actuator spring 46 again biases the actuator 30 away from the second scale 22 to the hold position. With the actuator 30 biased away from the second scale 22 to the hold position, the lever 40 pivots with respect to the casing 12 to again force the lock 38 toward the second scale 22 to the hold position. In the hold position, the lock 38 engages with the detent 48 in the tang 34 of the blade 14 to prevent the blade 14 from rotating with respect to the casing 12.

As shown in FIGS. 1-6, embodiments of the present invention also include a safety lever 50 inside the cavity 26 that extends through at least a portion of the casing 12. A pin 52 may pivotally connect the safety lever 50 to the casing 12 so that the safety lever 50 may pivot between a lock position (shown in FIGS. 7-9 and 14) that prevents operation of the actuator 30 and an unlock position (shown in FIGS. 10-13 and 15) that permits operation of the actuator 30.

Figure 7:
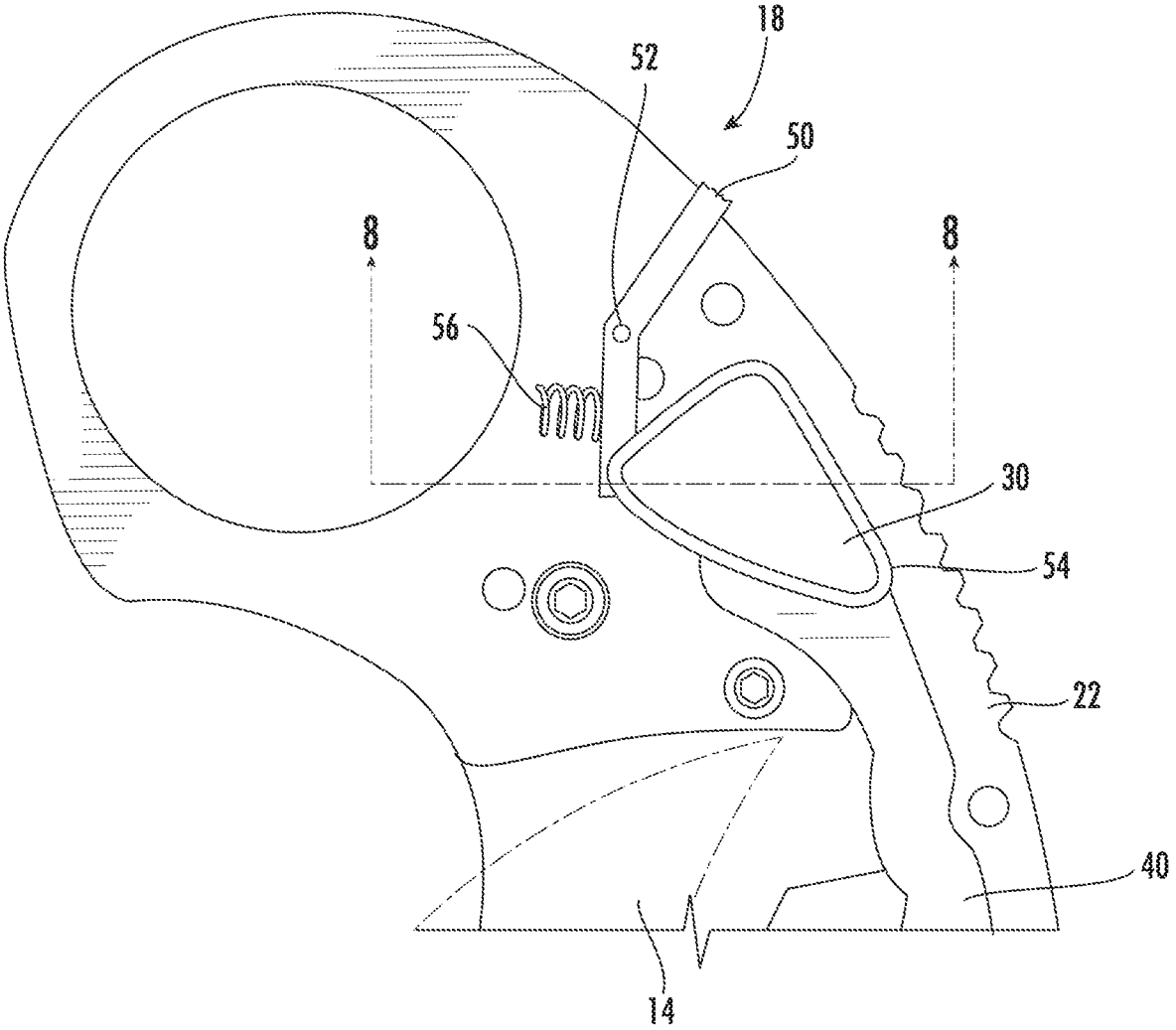
FIG. 7 is a top plan view of the second end of the switchblade shown in FIG. 2 with the top scale removed and the safety lever in a lock position.
Figure 8:
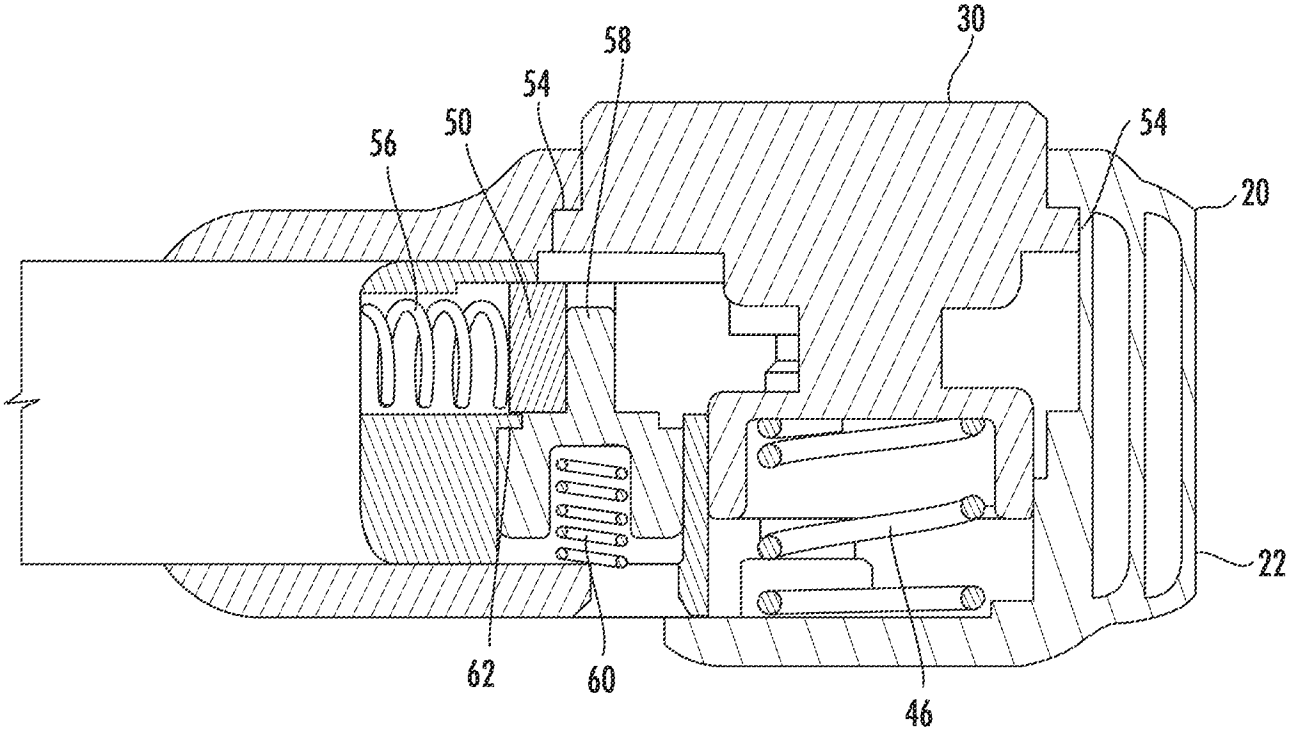
FIG. 8 is a cross-section view of the switchblade shown in FIG. 7 taken along line 88 with the actuator in the hold position and the safety lever in the lock position.
Figure 9:
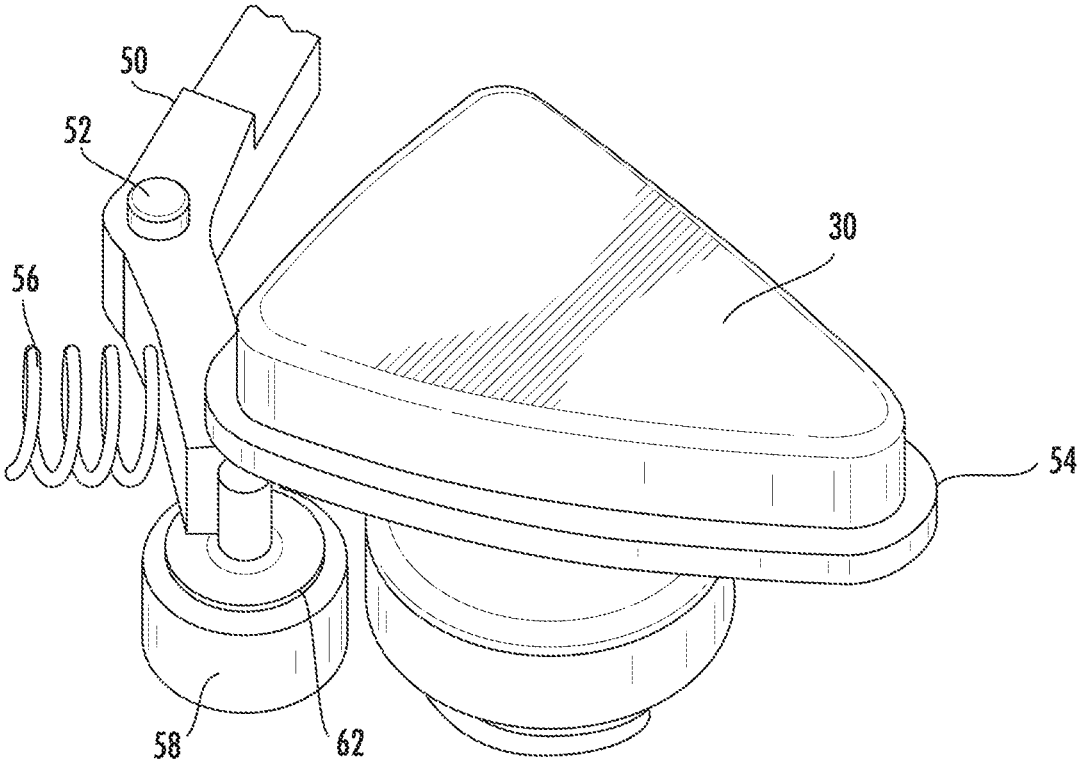
FIG. 9 is a perspective view of the actuator and safety lever shown in FIGS. 7 and 8.

FIGS. 7-9 provide top plan, cross-section, and perspective views, respectively, of the second end 18 of the switchblade 10 to illustrate the actuator 30 in the hold position and the safety lever 50 in the lock position while the blade 14 is in the retracted position. As shown most clearly in FIG. 8, the actuator spring 46 biases the actuator 30 away from the second scale 22 to the hold position, and a flange 54 around the actuator 30 engages with the first scale 20 to retain the actuator 30 inside the casing 12. A safety lever spring 56 biases the safety lever 50 to the lock position against a detent 58 inside the cavity 26. In the lock position, the safety lever 50 limits downward movement of the actuator 30 as shown in FIG. 8. As a result, the safety lever 50 prevents the actuator 30 from being repositioned to the release position to prevent the blade 14 from being deployed.

Figure 10:
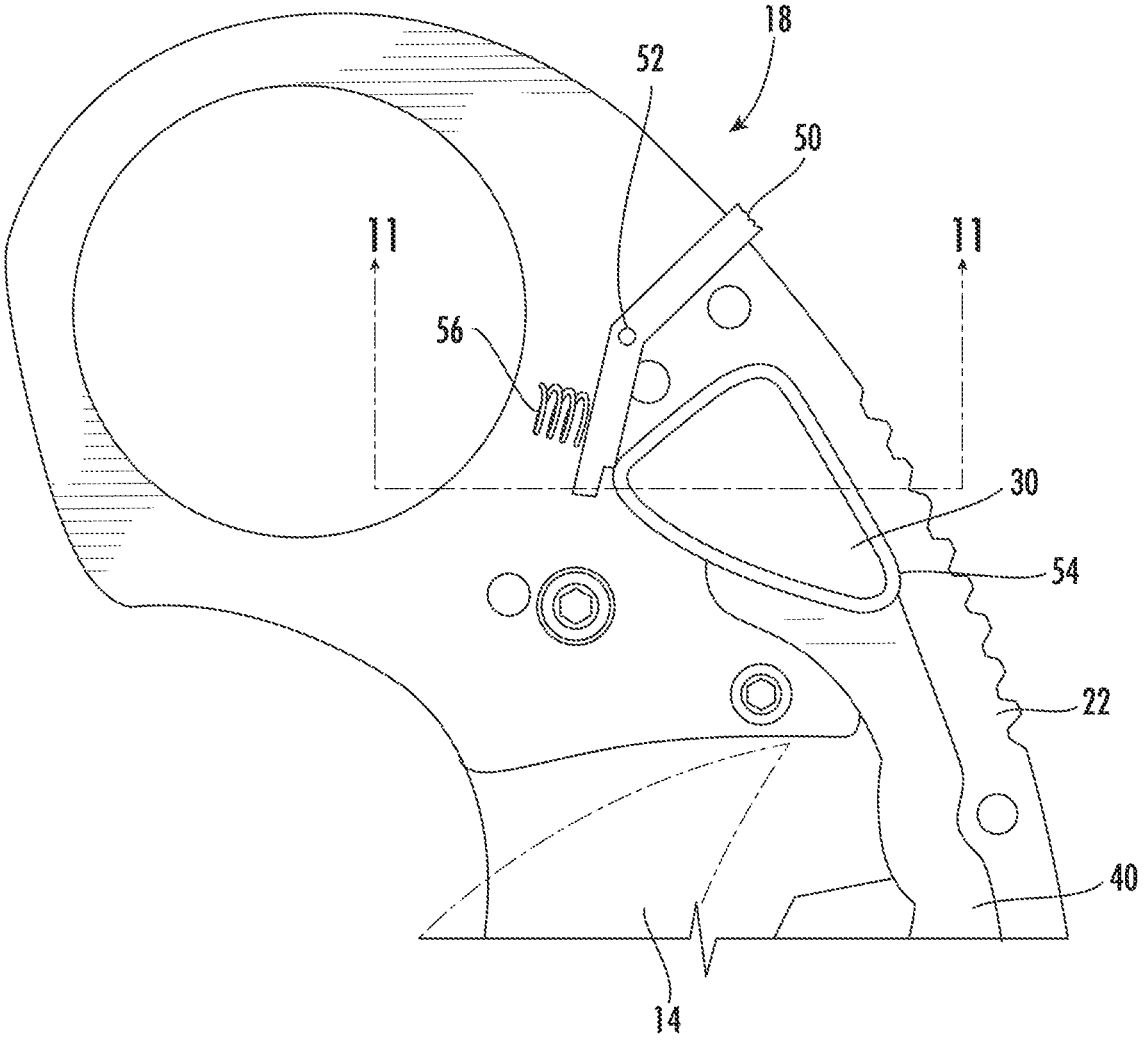
FIG. 10 is a top plan view of the second end of the switchblade shown in FIG. 2 with the top scale removed and the safety lever in an unlock position.
Figure 11:
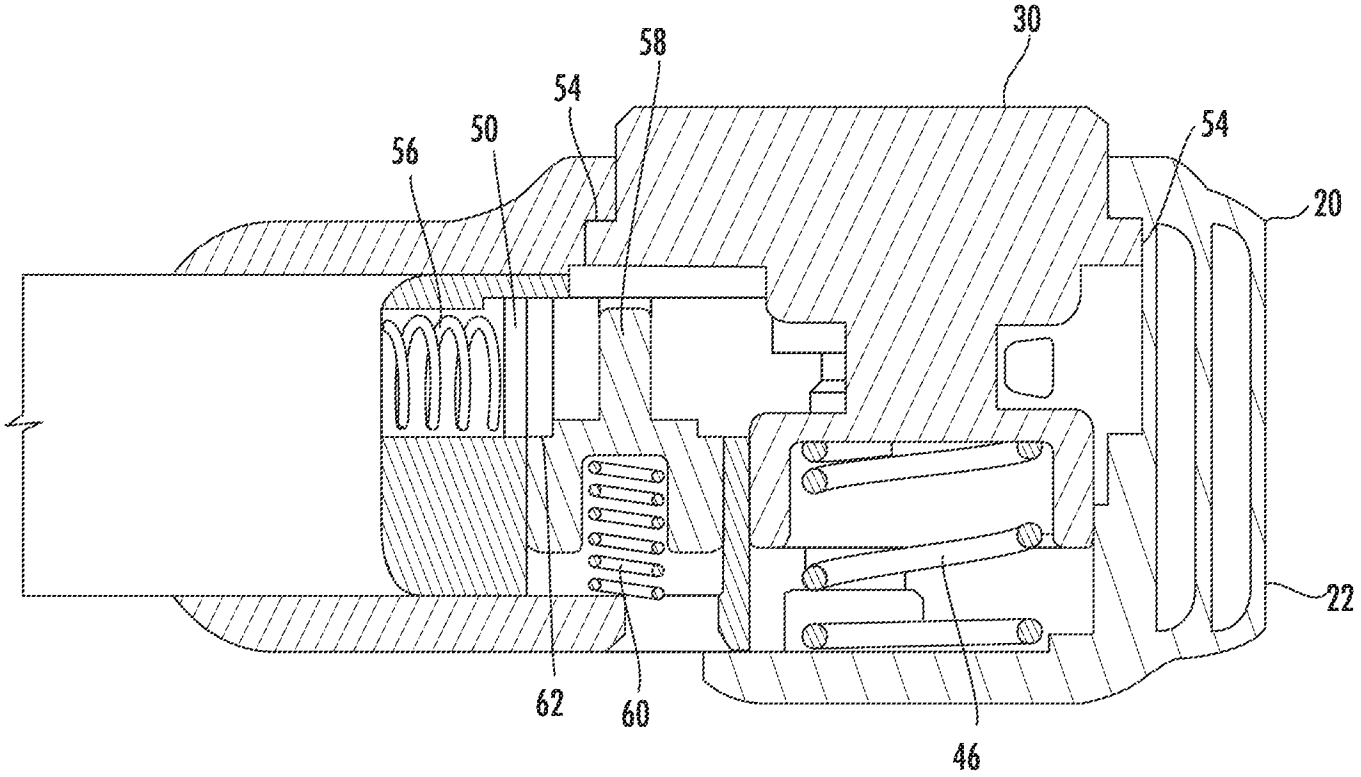
FIG. 11 is a cross-section view of the second end of the switchblade shown in FIG. 10 taken along line 11-11 with the actuator in the hold position and the safety lever in the unlock position.
Figure 12:
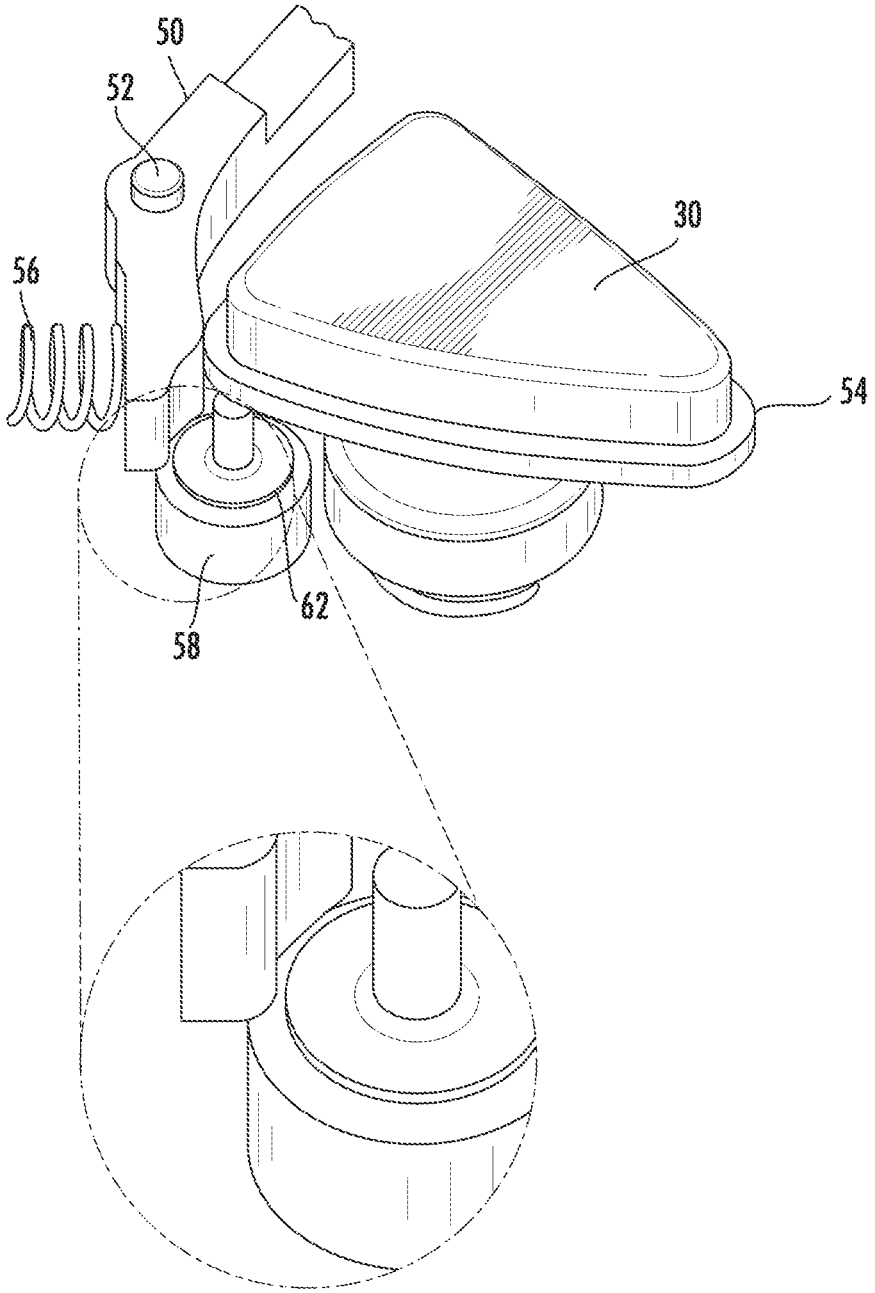
FIG. 12 is a perspective view of the actuator and safety lever shown in FIGS. 10 and 11.

FIGS. 10-15 illustrate operation of the actuator 30 and safety lever 50 when deploying and retracting the blade 14. FIGS. 10-12 provide top plan, cross-section, and perspective views, respectively, of the second end 18 of the switchblade 10 to illustrate the actuator 30 in the hold position and the safety lever 50 in the unlock position while the blade 14 is in the retracted position. As shown most clearly in FIG. 10, the safety lever 50 has been rotated clockwise around the pin 52 to depress the safety lever spring 56. As shown most clearly in FIG. 11, the actuator spring 46 continues to bias the actuator 30 away from the second scale 22 to the hold position, and the flange 54 around the actuator 30 remains engaged with the first scale 20 to retain the actuator 30 inside the casing 12. As shown most clearly in FIGS. 11 and 12, the clockwise rotation of the safety lever 50 around the pin 52 has moved the safety lever 50 from under the actuator 30 and allowed a detent spring 60 to bias the detent 58 away from the second scale 22 toward the actuator 30. With the detent 58 in a higher position as shown in FIGS. 11 and 12, a flange 62 around the detent 58 releasably engages with the safety lever 50 to hold the safety lever 50 in the unlock position. As a result, the actuator 30 may be depressed to overcome the bias provided by the actuator spring 46 to reposition the actuator 30 to the release position to deploy the blade 14.

Figure 13:
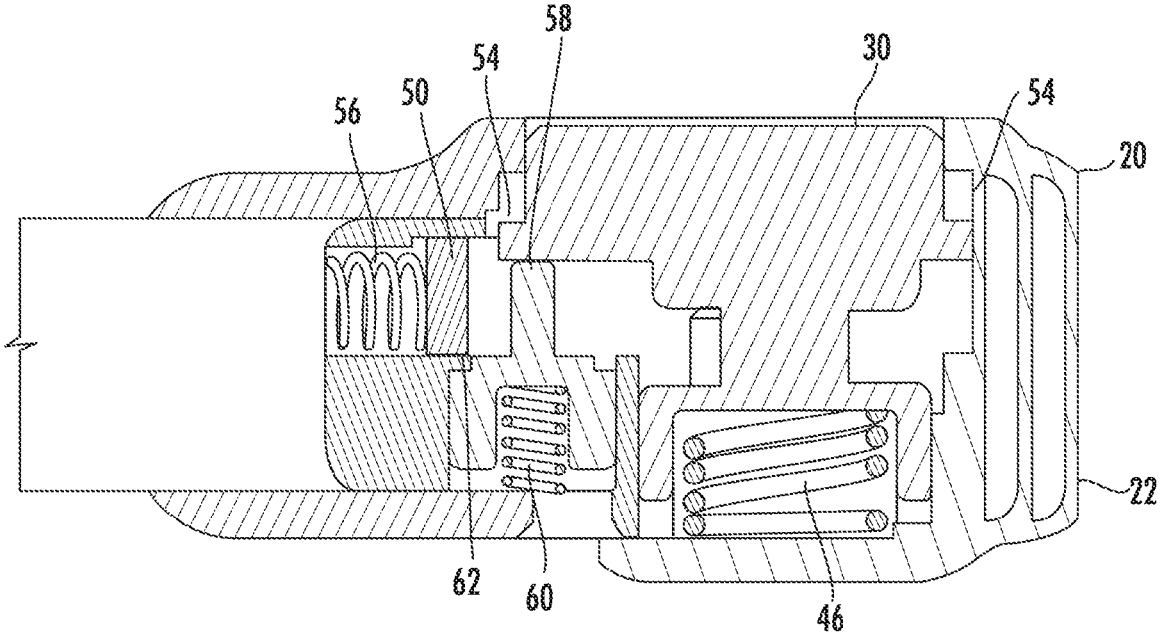
FIG. 13 is a cross-section view of the second end of the switchblade shown in FIG. 10 taken along line 11-11 with the actuator in the release position and the safety lever in the unlocked position.

As shown in FIG. 13, with the safety lever 50 starting in the unlock position as shown in FIGS. 10-12, the actuator 30 has been depressed toward the second scale 22 to overcome the bias provided by the actuator spring 46 and reposition the actuator 30 to the release position. Downward movement of the actuator 30 toward the second scale 22 causes the actuator 30 to engage with the detent 58 to overcome the bias provided by the detent spring 60 and move the detent 58 downward toward the second scale 22. With the detent 58 in the lower position, the flange 62 around the detent 58 no longer engages with the safety lever 50, allowing the safety lever spring 56 to again bias the safety lever 50 toward the lock position. However, the flange 54 around the actuator 30 blocks the safety lever 50 from reaching the lock position while the actuator 30 is depressed to the release position. As a result, the actuator 30 may continue to move downward to the release position to reposition the lock 38 to the release position and allow the blade 14 to be deployed as previously described with respect to FIGS. 5 and 6.

Figure 14:
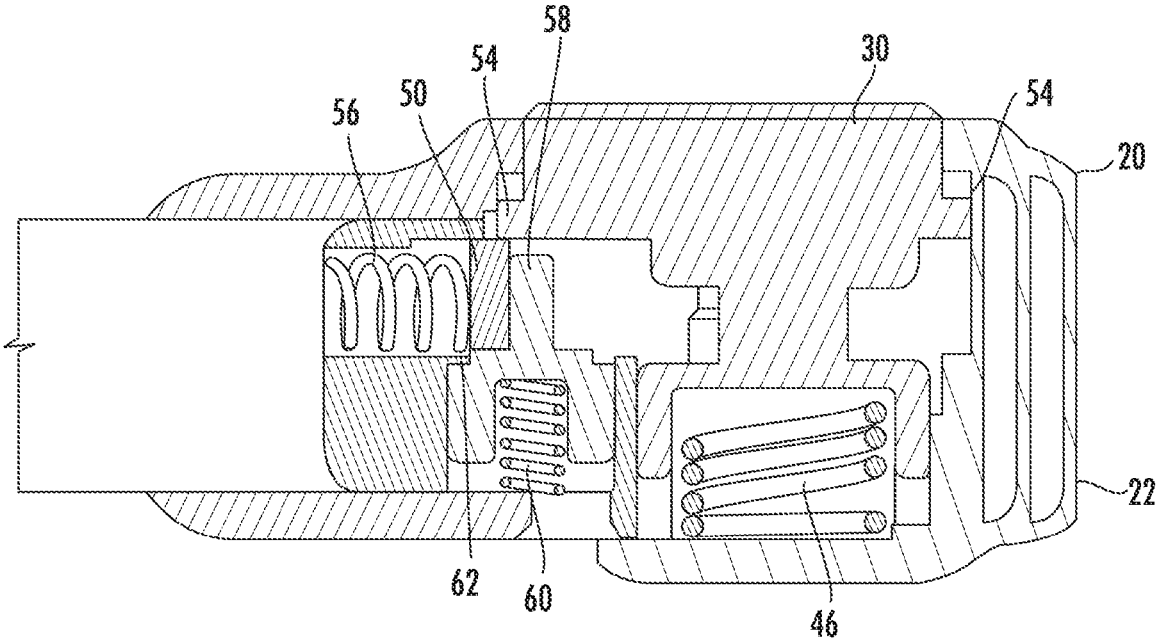
FIG. 14 is a cross-section view of the second end of the switchblade shown in FIG. 7 taken along line 8-8 with the actuator in the hold position and the safety lever in the lock position with the blade deployed.

Once the blade 14 has been deployed, the actuator 30 is no longer depressed, and the actuator spring 46 again biases the actuator 30 away from the second scale 22 to reposition the actuator 30 to the hold position. As the actuator 30 returns to the hold position with the blade 14 in the deployed position, the lock 38 engages with the detent 48 in the tang 34 of the blade 14 to prevent the blade 14 from rotating with respect to the casing 12 as previously described with respect to FIGS. 5 and 6. The engagement between the lock 38 and the tang 34 of the blade 14 in the deployed position prevents the actuator 30 from returning to the uppermost position. However, the actuator 30 has moved sufficiently upward and away from the second scale 22 to allow the safety lever spring 56 to bias the safety lever 50 to the lock position. As a result, the safety lever 50 is biased against the detent 58 beneath the actuator 30, and the safety lever 50 prevents the actuator 30 from being depressed to the release position to prevent the blade 14 from being retracted, as shown in FIG. 14.

Figure 15:
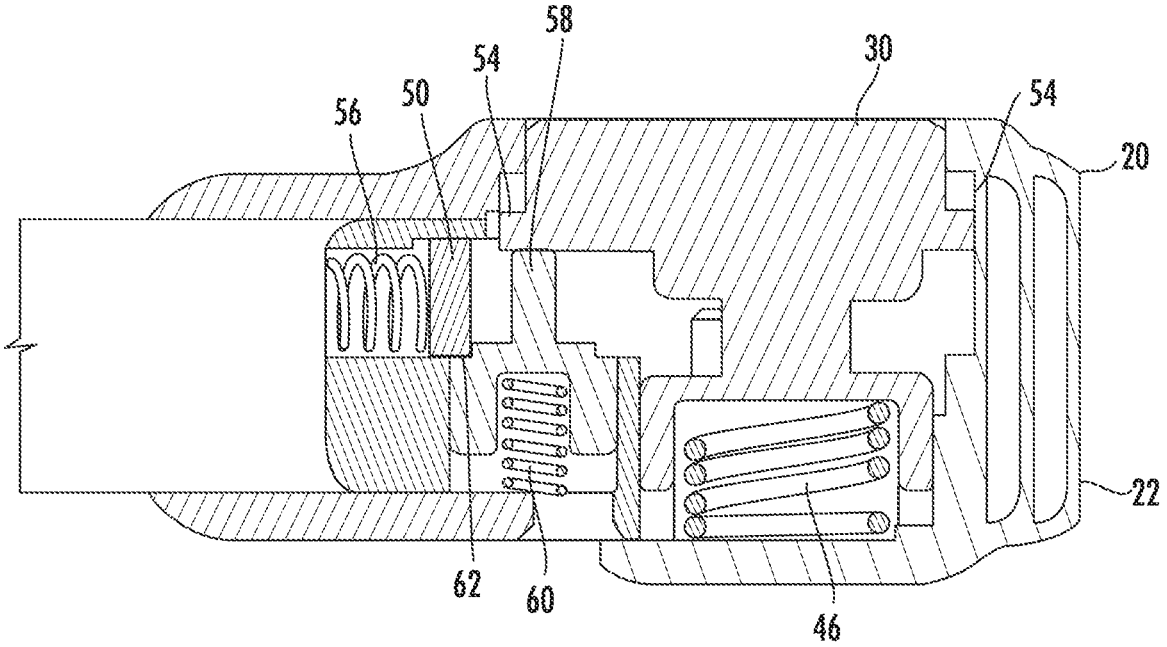
FIG. 15 is a cross-section view of the second end of the switchblade shown in FIG. 10 taken along line 11-11 with the actuator in the hold position and the safety lever in the unlock position.

To retract the blade 14, the safety lever 50 is again rotated clockwise around the pin 52 as shown in FIG. 10 to depress the safety lever spring 56 and reposition the safety lever 50 to the unlock position. The clockwise rotation of the safety lever 50 around the pin 52 moves the safety lever 50 from under the actuator 30 and allows the detent spring 60 to bias the detent 58 away from the second scale 22 toward the actuator 30. As the detent 58 moves upward, the flange 62 around the detent 58 releasably engages with the safety lever 50 to hold the safety lever 50 in the unlock position, as shown in FIG. 15. As a result, the actuator 30 may be depressed to overcome the bias provided by the actuator spring 46 to reposition the actuator 30 to the release position to retract the blade 14.

With the safety lever 50 now in the unlock position as shown in FIG. 15, the actuator 30 may be depressed toward the second scale 22 to overcome the bias provided by the actuator spring 46 and reposition the actuator 30 to the release position. Downward movement of the actuator 30 toward the second scale 22 causes the actuator 30 to engage with the detent 58 to overcome the bias provided by the detent spring 60 and move the detent 58 downward toward the second scale 22. With the detent 58 in the lower position, the flange 62 around the detent 58 no longer engages with the safety lever 50, allowing the safety lever spring 56 to again bias the safety lever 50 toward the lock position. However, the flange 54 around the actuator 30 blocks the safety lever 50 from reaching the lock position while the actuator 30 is depressed to the release position. As a result, the actuator 30 may continue to move downward to the release position to reposition the lock 38 to the release position and allow the blade 14 to be retracted as previously described with respect to FIGS. 5 and 6.

Once the blade 14 is retracted, the actuator 30 may be released, and the actuator spring 46 again biases the actuator 30 away from the second scale 22 to reposition the actuator 30 to the hold position. As the actuator 30 returns to the hold position with the blade 14 in the retracted position, the lock 38 engages with the detent 48 in the tang 34 of the blade 14 to prevent the blade 14 from rotating with respect to the casing 12 as previously described with respect to FIGS. 5 and 6. In addition, the safety lever spring 56 biases the safety lever 50 to the lock position biased against the detent 58 beneath the actuator 30. As a result, the safety lever 50 prevents the actuator 30 from being depressed to the release position to prevent the blade 14 from being retracted, as shown in FIGS. 7-9.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A switchblade, comprising:

a casing having a first end and an opposed second end, wherein said casing defines a cavity;

a blade movably connected to said casing and having a cutting edge, wherein said blade has a retracted position in which said cutting edge is inside said cavity and a deployed position in which said cutting edge is outside said cavity;

a spring inside said casing and operably connected to said blade to bias said blade to said deployed position;

a lock in said cavity at said first end of said casing;

a lever engaged with said lock at said first end of said casing and extending toward said second end of said casing;

an actuator engaged with said lever at said second end of said casing and extending through at least a portion of said second end of said casing, wherein said actuator has a hold position that positions said lock to engage with said blade to prevent movement of said blade with respect to said casing in at least one of said retracted or deployed positions and a release position that positions said lock to permit movement of said blade with respect to said casing; and a safety lever pivotally connected to said casing, wherein said safety lever has a lock position engaged with said actuator that prevents operation of said actuator and an unlock position that permits operation of said actuator.

2. The switchblade as in claim 1, wherein said actuator is configured to be biased to said hold position.

3. The switchblade as in claim 1, wherein said safety lever is configured to be biased to said lock position.

4. The switchblade as in claim 1, further comprising a detent in said cavity that releasably engages with said safety lever to hold said safety lever in said unlock position.

5. The switchblade as in claim 4, wherein said detent is configured to be biased toward said actuator.

6. The switchblade as in claim 5, wherein said detent repositions toward said actuator when said safety lever is moved to said unlock position.

7. The switchblade as in claim 4, wherein said actuator engages with said detent when said actuator is repositioned from said hold position to said release position to reposition said detent and allow said safety lever to move to said lock position.

8. The switchblade as in claim 1, wherein said blade is pivotally connected to said casing, and said blade pivots with respect to said casing when said blade moves from said retracted position to said deployed position.

9. A switchblade, comprising:

a casing having a first end and an opposed second end, wherein said casing defines a cavity;

a blade movably attached to said casing and having a cutting edge, wherein said blade has a retracted position in which said cutting edge is inside said cavity and a deployed position in which said cutting edge is outside said cavity;

a spring inside said casing and operably connected to said blade to bias said blade to said deployed position;

a lock in said cavity at said first end of said casing, wherein said lock has a hold position engaged with said blade that prevents movement of said blade with respect to said casing in at least one of said retracted or deployed positions and a release position that permits movement of said blade with respect to said casing;

a lever engaged with said lock at said first end of said casing and extending toward said second end of said casing;

an actuator engaged with said lever at said second end of said casing, wherein operation of said actuator repositions said lock to said release position to allow said blade to move between said retracted position and said deployed position; and a safety lever pivotally connected to said casing that extends through at least a portion of said casing, wherein said safety lever has a lock position engaged with said actuator that prevents operation of said actuator and an unlock position that permits operation of said actuator.

10. The switchblade as in claim 9, wherein said safety lever is configured to be biased to said lock position.

11. The switchblade as in claim 9, further comprising a detent in said cavity that releasably engages with said safety lever to hold said safety lever in said unlock position.

12. The switchblade as in claim 11, wherein said detent is configured to be biased toward said actuator.

13. The switchblade as in claim 11, wherein said detent repositions toward said actuator when said safety lever is moved to said unlock position.

14. The switchblade as in claim 11, wherein operation of said actuator repositions said detent to allow said safety lever to move to said lock position.

15. The switchblade as in claim 9, wherein said blade is pivotally connected to said casing, and said blade pivots with respect to said casing when said blade moves from said retracted position to said deployed position.

16. A switchblade, comprising:

a casing having a first end and an opposed second end, wherein said casing defines a cavity;

a blade pivotally attached to said casing and having a cutting edge, wherein said blade has a retracted position in which said cutting edge is inside said cavity and a deployed position in which said cutting edge is outside said cavity;

a spring inside said casing and operably connected to said blade to bias said blade to said deployed position;

a lock in said cavity at said first end of said casing, wherein said lock has a hold position engaged with said blade that prevents movement of said blade with respect to said casing in at least one of said retracted or deployed positions and a release position that permits movement of said blade with respect to said casing;

a lever engaged with said lock at said first end of said casing and extending toward said second end of said casing;

an actuator engaged with said lever at said second end of said casing and extending through at least a portion of said casing, wherein operation of said actuator repositions said lock to allow said blade to move between said retracted position and said deployed position; and a safety lever at least partially inside said casing and pivotally connected to said casing, wherein said safety lever has a lock position engaged with said actuator that prevents operation of said actuator and an unlock position that permits operation of said actuator.

17. The switchblade as in claim 16, wherein said safety lever is configured to be biased to said lock position.

18. The switchblade as in claim 16, further comprising a detent in said cavity that releasably engages with said safety lever to hold said safety lever in said unlock position.

19. The switchblade as in claim 18, wherein said detent repositions toward said actuator when said safety lever is moved to said unlock position.

20. The switchblade as in claim 18, wherein operation of said actuator repositions said detent to allow said safety lever to move to said lock position.

* * * * *